US005393933A

United States Patent [19]

Goertz

[11] Patent Number: 5,393,933

[45] Date of Patent: Feb. 28, 1995

[54] CHARACTERISTIC IMPEDANCE CORRECTED AUDIO SIGNAL CABLE

[76] Inventor: Ole S. Goertz, Engbakken 17, DK 2830 Virum, Denmark

[21] Appl. No.: 31,687

[22] Filed: Mar. 15, 1993

[51] Int. Cl.[6] ..... H01B 7/08

[52] U.S. Cl. ..... 174/117 R; 174/102 R; 174/117 F; 174/117 FF

[58] Field of Search ..... 174/117 FF, 117 F, 117 R, 174/102 R

[56] References Cited

U.S. PATENT DOCUMENTS

| | | | |
|---|---|---|---|
| 2,298,428 | 10/1942 | Smith | 174/102 R |
| 3,586,757 | 6/1971 | Haldeman, Jr. | 174/117 FF |
| 4,208,542 | 6/1980 | Endo | 174/113 C |
| 4,552,990 | 11/1985 | Persson et al. | 174/117 FF |
| 4,568,401 | 2/1986 | Davis | 156/55 |
| 4,808,773 | 2/1989 | Crandall | 174/113 R |
| 4,816,611 | 3/1989 | Invernizzi | 174/102 R |
| 4,945,189 | 7/1990 | Palmer | 174/32 |
| 4,954,095 | 9/1990 | Cogan | 174/27 |
| 5,266,744 | 11/1993 | Fitzmaurice | 174/103 |

FOREIGN PATENT DOCUMENTS

| | | | |
|---|---|---|---|
| 28459 | of 1912 | United Kingdom | 174/117 FF |
| 1156133 | 6/1969 | U.S.S.R. | 174/117 FF |
| 599285 | 3/1978 | U.S.S.R. | 174/117 FF |

*Primary Examiner*—Morris H. Nimmo
*Attorney, Agent, or Firm*—John H. Crozier

[57] ABSTRACT

Audio signal cable for interconnecting a power source and a load, e.g. a power amplifier and a loudspeaker, wherein the geometry of the conductors and the dielectric which separates them has been adapted to raise the capacitance and lower the inductance of the cable, therewith lowering its characteristic impedance to the same order as that of the load, typically 2–10 ohms. In a preferred embodiment this is done by providing a positive and a negative conductor each composed of a solid band of e.g. copper, substantially as wide as the cable which are sandwiched together with a thin interlayer of a dielectric material, e.g. polyester film.

3 Claims, 5 Drawing Sheets

TIME BASE = 10μS
CH1 V/DIV = 0.5V
CH2 V/DIV = 0.5V

TIME BASE = 10μS
CH1 V/DIV = 0.5V
CH2 V/DIV = 0.5V

CHARACTERISTIC IMPEDANCE CORRECTED AUDIO SIGNAL CABLE

BACKGROUND OF THE INVENTION

1. Field of the Invention.

This invention relates to audio cables generally and, more particularly, to a novel audio signal cable in which the geometry of the conductors therein and the dielectric which separates them has been arranged to raise the capacitance and lower the inductance of the cable, therewith lowering its characteristic impedance to the same order as that of the load, typically 2 to 10 ohns.

2. Background Art.

Ever since the development of high fidelity stereo technology a great deal of effort has been directed towards eliminating sound distortion due to imperfections in microphones, amplifiers and loudspeakers. As the components have been improved, it has become increasingly important that the signal is transmitted unimpaired between amplifiers and speakers and this has required special attention to the construction and routing of speaker cables.

Most conventional cables, including loudspeaker cables, have a relatively high "characteristic impedance in the range of 50 to 100 ohms. The characteristic impedance of a signal transmission cable is independent of its length but depends on its construction and the mutual distance and kind of insulation used between the conductors.

In this context, it is a serious limitation of conventional cables that their characteristic impedance is much higher than the impedance of loudspeakers which is mostly in the range of 2 to 8 ohms. The ensuing problem is heard in reflections, due to impedance mismatch, which impair sound quality increasingly as cables get longer. Measurements indicate that this kind of signal distortion becomes notable at the high end of the audible field starting with speaker cables as short as 10 feet.

The resultant loss of fidelity is especially important in fast, transient signals which are impaired by a much slower rise time at the speaker than at the amplifier. In many cases, several speakers are connected in parallel to the same cable, further lowering the load and enhancing the impedance mismatch. In addition, in cases where the cable is left open, or almost open, e.g., connected to a high impedance headphone, the result is severe HF ringing.

The kind of distortion described in the above comes into play in complex stereo music signals by disturbing the phase relationship between signal components of different frequencies. The result is that the sound becomes diffuse and less distinct with increasing cable length. This effect should not be confused with the well known signal clipping.

Especially in stereo sound, fidelity is dependent on extremely small differences interpreted by the human ear to perceive the location of each instrument among a multitude of instruments, e.g., in a symphony orchestra. In this case, phase distortion will disturb the impression of being present in the concert hall.

In large audio speaker systems, e.g., cinema systems, often frequency adjustments are required of the individual channels in order to compensate for differences in cable length and thus to repair the before mentioned phase and frequency dependence. Such adjustment would not be required if speaker cables were designed to match the characteristic impedance of the speakers.

In addition, all audio amplifiers use negative feedback to control and stabilize the amplification ratio and power bandwidth. The load impedance has to be taken into account when the feedback loop is calculated and fine tuned for the desired frequency response. Using a speaker cable with the correct characteristic impedance will greatly reduce the variation in load impedance with frequency.

Another problem related to conventional twin lead cables is that they are relatively open to neighboring fields because of the distance between the conductors. The effect of this may be overplay between channels when cables are routed together, or line frequency hum picked up from adjacent power wiring. The kind of effects described may be avoided either by extensive cable shielding or separate routing, but either measure often adds considerably to installation costs.

SUMMARY OF THE INVENTION

The present invention deals with improvements in speaker cables by virtually eliminating the problems outlined in the above. In addition, cables according to the invention are more compact and easier to install and conceal than conventional speaker cables. Due to their construction, however, special measures are required for termination and splicing which may be facilitated by the use of specialized hardware, one embodiment of which will be described in the following.

Speaker cables according to the invention have a low characteristic impedance, typically under 10 ohms, effectively excluding signal distortion from impedance mismatch. In addition, due to their geometry, they are virtually immune to neighboring fields and may be bundled or routed next to power lines without the effects described above.

According to the invention, this can be achieved by exchanging the conventional conductors in a cable with wide bands composed of solid foil or strip or a multitude of closely juxtaposed wires of conductive material. A preferred embodiment of a twin cable according to the invention may consist of two such bands sandwiched close together with a thin interlayer of a suitable dielectric material like, e.g., polyester film, and surrounded by a common sheath of suitable insulation. The effect of this construction is a drastic increase in capacity and a simultaneously reduced inductance, compared to conventional cables, which together bring along the desired reduction in characteristic impedance. At the same time, because of the mutual proximity of the band conductors, the cable is virtually immune to outside fields and the emission of low frequency magnetic fields, which some people consider a health hazard, is virtually eliminated.

BRIEF DESCRIPTION OF THE DRAWING

The invention will be described in the following with reference to the drawing wherein.

DETAILED DESCRIPTION OF THE PREFERRED EMBODIMENTS

Figure 1:
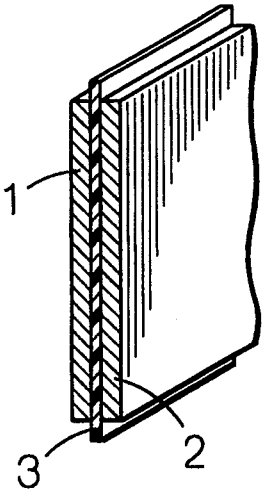

In FIG. 1, elements 1 and 2 indicate flat strips of a conducting material, e.g., copper or aluminum placed on each side of a somewhat wider, interlayer 3 consisting of a dielectric material, e.g., polyester film. The dimensions of the strip depend on system requirements but a good example for audiophile application would be copper strip 0.375" wide by 0.010" thick, yielding almost the same conductive cross section as the 12 gauge wire now being used increasingly in residential stereo systems.

The cable of FIG. 1 is the simplest embodiment possible of a cable according to the invention, having no external insulation at all. Because of the normally low signal voltage, there is no danger of electrical shock to a person touching the cable, and due to the two sided construction and the protruding fringes of the separating film, there is also little chance of a short circuit caused by contact with adjacent metallic building elements.

Figure 2:
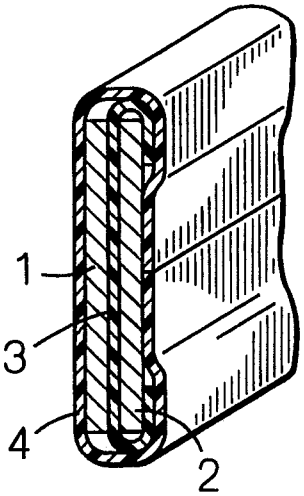

FIG. 2 is another embodiment of a cable according to the invention wherein the separating film 3 has been folded or cuffed around the edges of one of the strip conductors and a second film strip 4 folded around the entire sandwich, either leaving an area of one conductor open or enclosing completely the two conductors 1 and 2 and the separating film 3. It is a matter of course that the film layers referred to in the above can be replaced by, e.g., extruded insulation, still within the scope of the invention.

Figure 3:
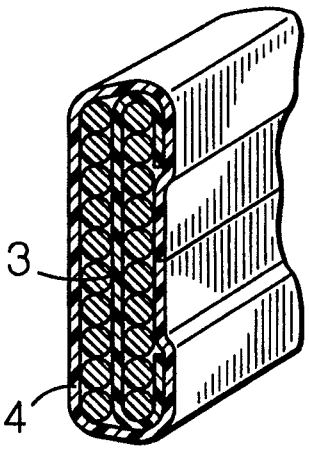

FIGS. 3 is a construction similar to the one shown in FIG. 2, the only difference being that the solid bands 1 and 2 are exchanged with bands of closely juxtaposed multiple wires. This cable can be terminated in the conventional manner by stripping and twisting the wires of each lead in turn.

Figure 4:
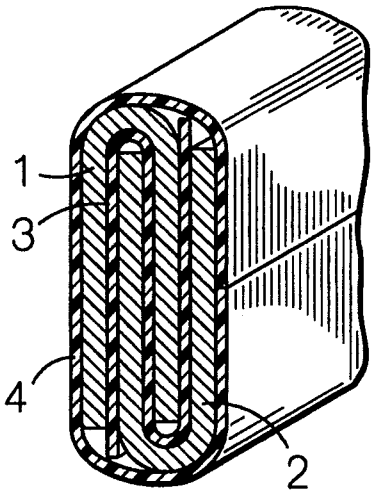
FIGS. 1, 2, 3 and 4 are embodiments of cables according to the invention.

FIG. 4 is a cable according to the same basic principle utilizing even wider, band shaped conductors which have been folded lengthwise and arranged in a mutually interlocking relationship, the objective being a further reduction of characteristic impedance combined with ease of installation through the reduction in width of the assembly. Another variation would be forming the cable into an elongated hollow tube, or the use of tubular conductors arranged concentrically surrounding a core of a filler material or air.

The characteristic impedance of the cables referred to in the above will depend largely on the width of the conductors and their mutual distance as well as the dielectric constant of the material of the interlayer. For example, using solid conductors 0.375" wide and an interlayer of 0.003" thick polyester film will produce a cable having a characteristic impedance of approximately 4 ohms.

Figure 5A:
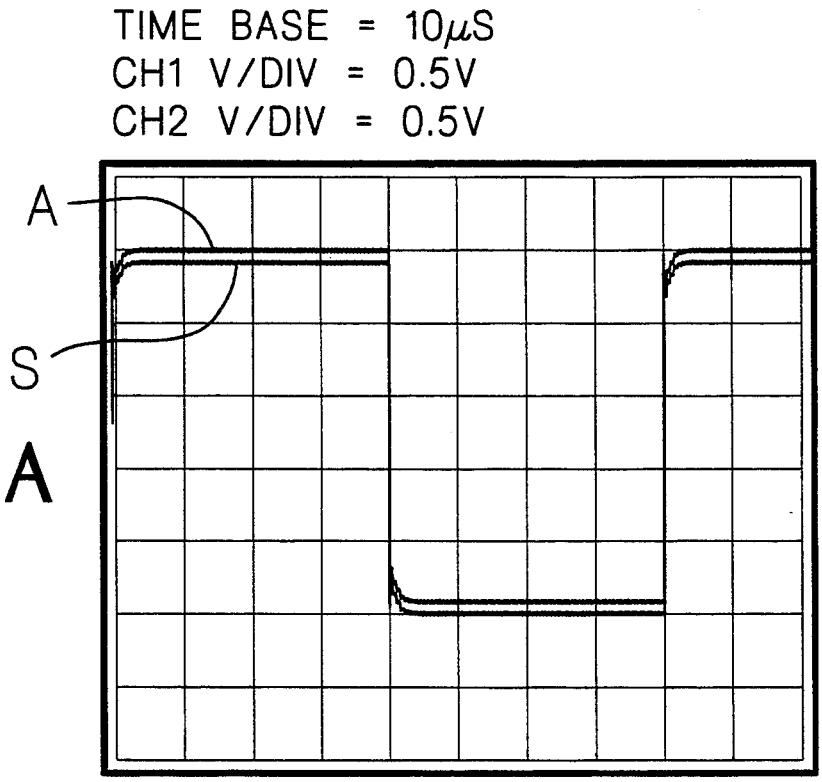
FIGS. 5A, 6A, and 7A illustrate performance measurements on cables constructed according to the present invention, under given load conditions.
Figure 5B:
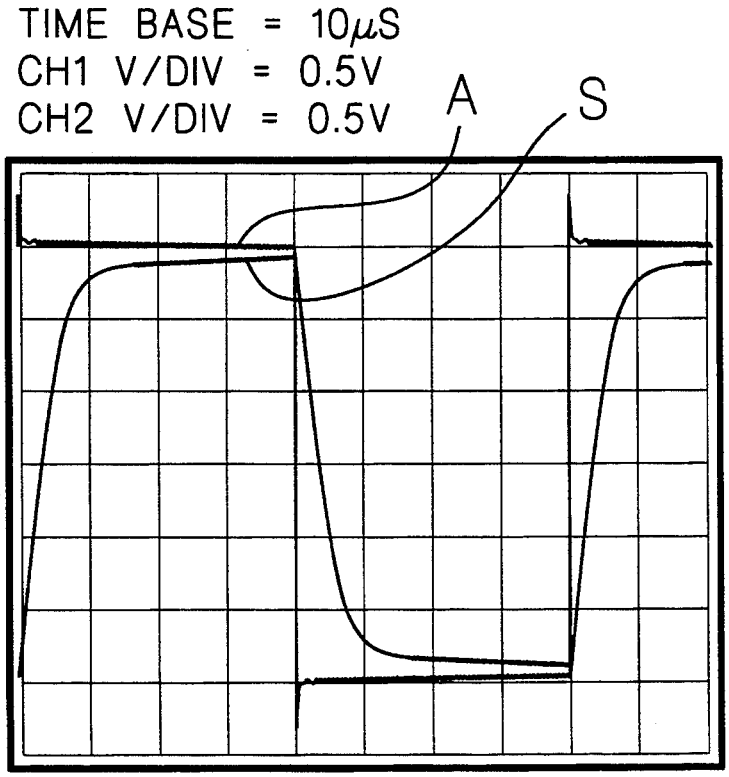
FIGS. 5B, 6B, and 7B illustrate performance measurements on conventional heavy gauge, twin lead speaker cables, under the respective load conditions of FIGS. 5A, 6A, and 7A.

FIG. 5 illustrates comparative measurements using a 12 KHz square wave transmitted via I, a 25 foot long cable according to the invention with a characteristic impedance of 4 ohms and II, an equally long cable of conventional construction with 100 ohms characteristic impedance, both connected to a 4 ohms load. A is the signal at the amplifier and S the signal at the speaker terminals. II indicates a clear leading edge spike at the amplifier and significant distortion at the speaker terminals. I, in contrast, is entirely distortion free, showing only the resistive loss en route.

Figure 6A:
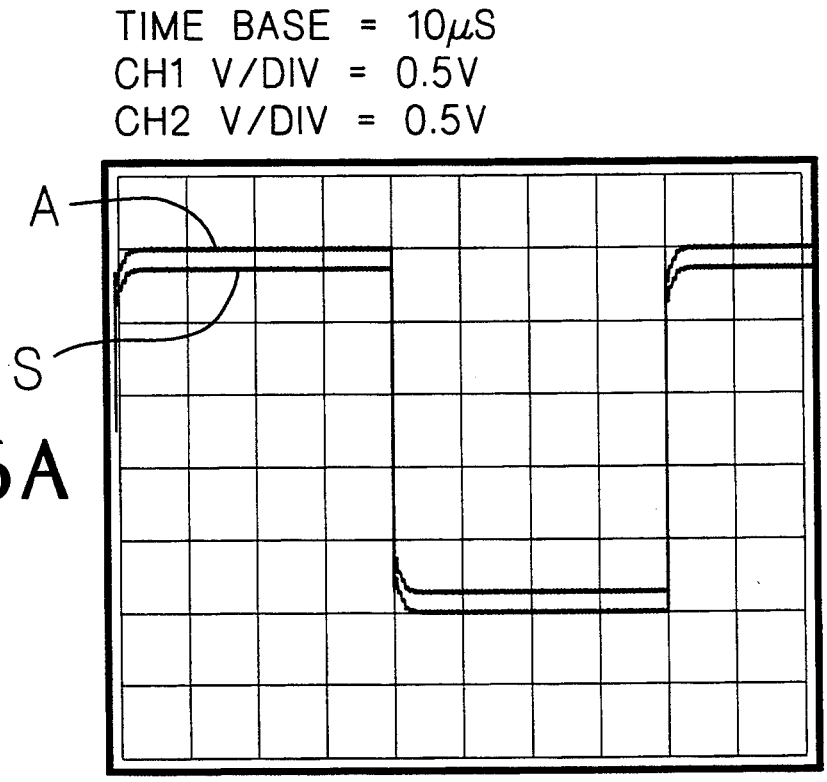
Figure 6B:
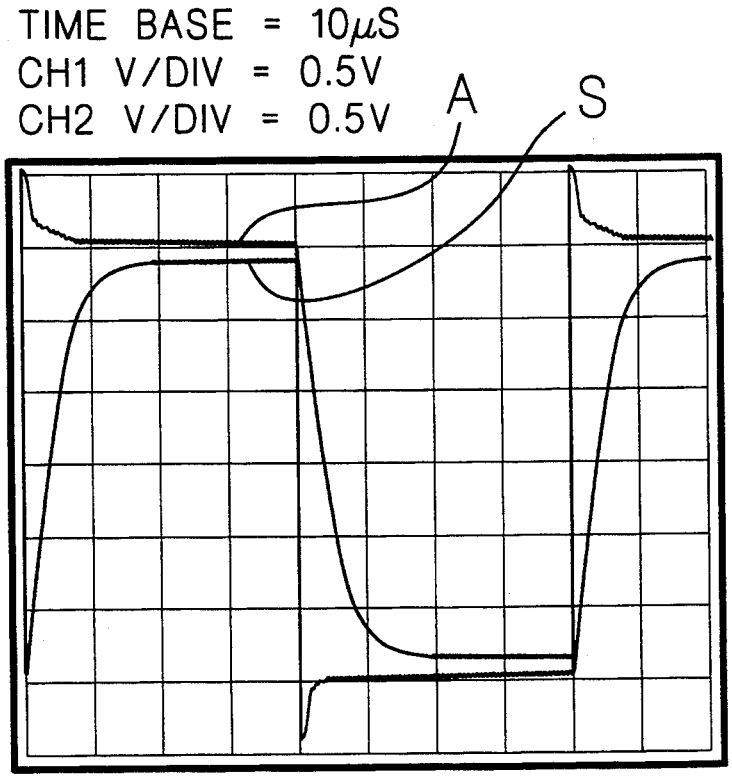

FIG. 6 is the same set up with a 2 ohm load, indicating aggravated distortion at both amplifier and speaker in the case of the conventional cable and no distortion with the new cable.

Figure 7A:
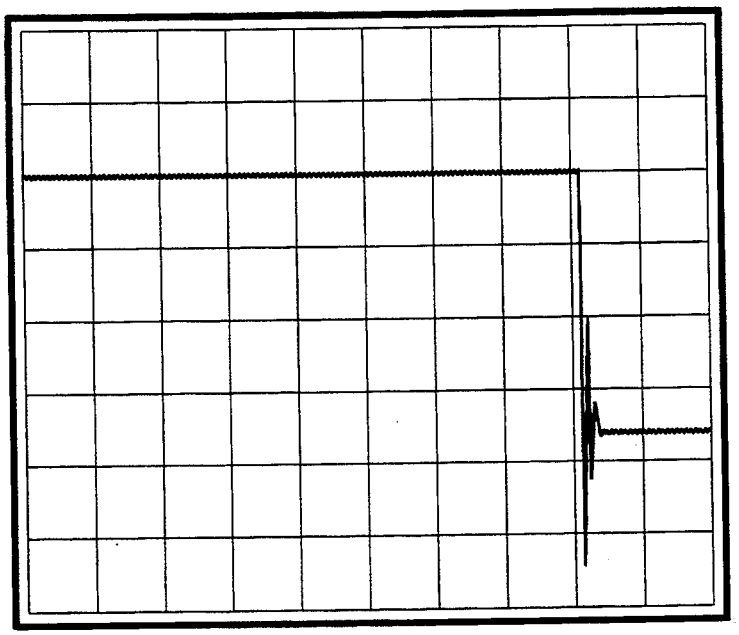
Figure 7B:
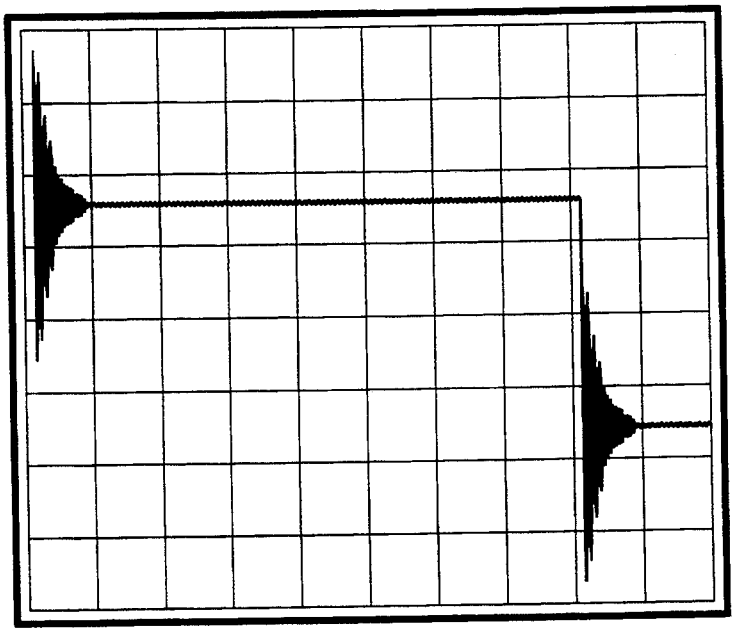

In FIG. 7, II is a conventional cable with no load attached showing severe VHF ringing. The cable acts like an antenna with implications of radio interference. I is the impedance corrected cable showing brief, very damped ringing.

Figures 8A, 8B, 8C:
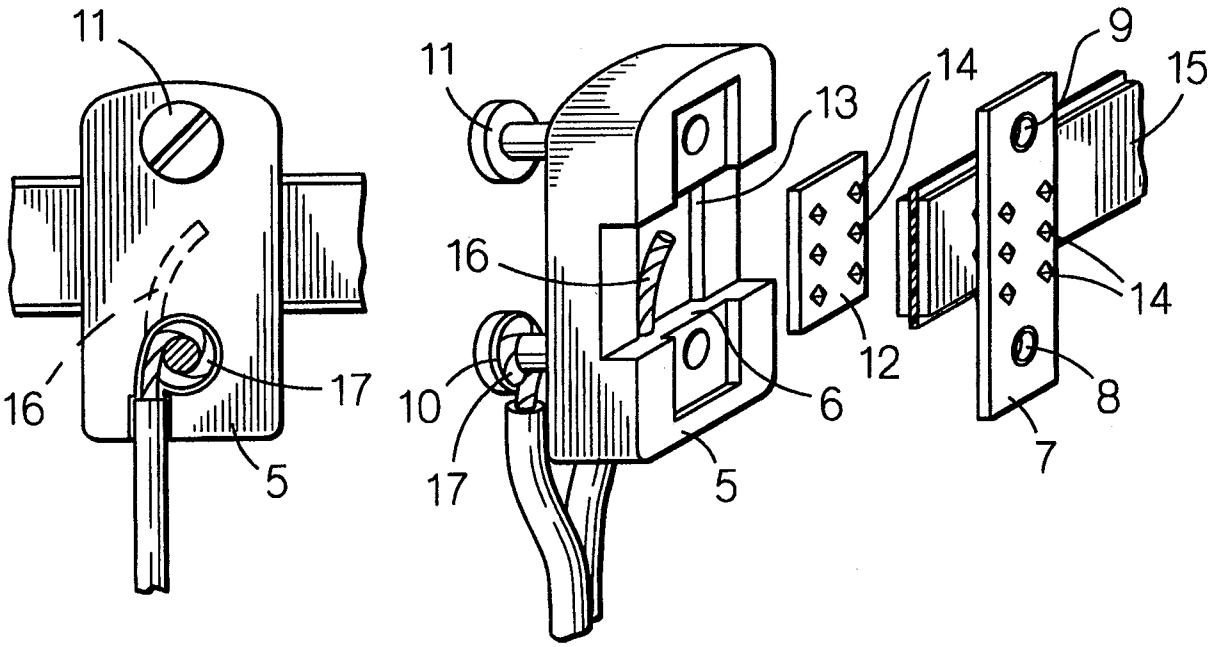
FIGS. 8A, 8B, and 8C are front elevational, isometric, and isometric detail views, respectively, of a clamp, also according to the invention, allowing convenient termination and splicing of the special flat speaker cables of the invention.

FIG. 8 is a preferred embodiment of a clamp suitable for termination and splicing of cables of the invention and comprising a non-conducting body 5, e.g., injection molded from a suitable thermoplastic, with a slot 6, somewhat wider than the cable, and a metal strap 7, having holes 8 and 9, threaded to accept screws 10 and 11, and a metallic insert 12, fitting in a depression 13 located at the bottom of slot 6. The strap and insert are each provided with sharp projections 14 facing each side of the cable 15 in turn as it is placed in slot 6. A short length of conventional cable is used for hook up to speakers and amplifier.

The clamp is suited for termination at either end, or at any point along a cable according to the invention, and for splicing two cables together, with or without simultaneous termination. In the following will be explained how it works:

Screws 10 and 11 are loosened and the cable 15 is inserted into slot 6 from one or the other side of the clamp, or one screw is unscrewed and the strap 7 opened and the clamp hooked onto the cable for midway termination. The hook up wire is stripped and one lead 16 inserted in the hole to emerge behind the insert 12, while the other lead 17 is guided around screw 10 just behind its head. As the screws are tightened, strap 7 will make contact with one side of the cable, cutting through any external insulation, and, at the same time, contact will be established between strap 7 and one of the hook up wires via screw 10. Simultaneously, the insert 12 will establish contact between the opposite side of the cable and the other hook up wire, and the termination is completed as the screws are tightened home.

The clamp described can also be used for splicing two cables together as they are inserted from either end with their ends not touching each other inside the clamp. Here mutual contact is established via the dual projections on the strap and the insert respectively, and a simultaneous termination can be carried out by means of a hook up wire if desired.

Most manufacturers of audiophile signal cable emphasize the importance of a very low capacity per linear unit and it is a very significant characteristic of the new cable that the capacitance may be, e.g., 100 times higher than in other cables. In the new cable, the impedance of the distributed capacitance and inductance cancel each other out and the result is a cable appearing to the amplifier as a purely resistive load. This fact is amply evident from the oscilloscope pictures which indicate a total elimination of both "kickback" to the amplifier and distortion at the speaker terminals even in the case of the 1:2 mismatch ratio illustrated in FIG. 6.

It is another feature of the cable according to the invention that the use of a high loss dielectric interlayer will serve to further dampen the ringing and "kickback"

at the expense of a marginal lowering of sound quality. This may be highly relevant, e.g., in the case of a public address system where many speakers are connected to one and the same cable loop and will serve to make messages more understandable.

Although only four alternative constructions of cable have been illustrated and described according to the invention, many modifications and variations thereof will be apparent to those skilled in the art, and accordingly it is intended in the claims to cover all such modifications and variations which fall within the spirit and scope of the invention.

I claim:

1. A ribbon shaped cable, for interconnecting a power source and a load, e.g. a power amplifier and a loudspeaker, comprising: two conductors and a dielectric strip or layer disposed between and separating the conductors, the conductors and the dielectric together being substantially rectilinear in cross section, wherein the conductors of the cable are parallel and the geometry of the conductors and the dielectric has been adapted to raise the capacitance and lower the inductance of the cable, therewith lowering its characteristic impedance to the same order as that of a load, typically 2–10 ohms.

2. A ribbon shaped cable according to claim 1, wherein the conductors are solid and band shaped, with one of the conductors being a positive conductor and the other being a negative conductor, and wherein the conductors are layered in close mutual relationship with a thin interlayer of a dielectric material.

3. A ribbon shaped cable according to claim 1, wherein the conductors are solid and band shaped, with one of the conductors being a positive conductor and the other being a negative conductor, and wherein the conductors are each composed of an array of closely juxtaposed, parallel wires, the conductors being disposed in close mutual relationship with a thin interlayer of dielectric material.

* * * * *